US009343812B2

(12) United States Patent
Wong et al.

(10) Patent No.: US 9,343,812 B2
(45) Date of Patent: May 17, 2016

(54) COMMUNICATION DEVICE AND ANTENNA ELEMENT THEREIN

(71) Applicant: Acer Incorporated, New Taipei (TW)

(72) Inventors: Kin-Lu Wong, New Taipei (TW); Meng-Ting Chen, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 287 days.

(21) Appl. No.: 14/060,869

(22) Filed: Oct. 23, 2013

(65) Prior Publication Data

US 2015/0035712 A1 Feb. 5, 2015

(30) Foreign Application Priority Data

Jul. 30, 2013 (TW) ..... 102127223 A

(51) Int. Cl.

| | |
|---|---|
| ***H01Q 9/00*** | (2006.01) |
| ***H01Q 7/00*** | (2006.01) |
| ***H01Q 1/24*** | (2006.01) |
| ***H01Q 9/42*** | (2006.01) |
| ***H01Q 5/321*** | (2015.01) |

(52) U.S. Cl.

CPC ..... *H01Q 7/00* (2013.01); *H01Q 1/243* (2013.01); *H01Q 5/321* (2015.01); *H01Q 9/42* (2013.01)

(58) Field of Classification Search

CPC ..... H01Q 7/00; H01Q 5/321; H01Q 9/42; H01Q 1/243

USPC ..... 343/741, 749, 846, 702

See application file for complete search history.

(56) References Cited

U.S. PATENT DOCUMENTS 7,764,236 B2 * 7/2010 Hill ..... H01Q 1/243 343/702

(Continued)

FOREIGN PATENT DOCUMENTS

| | | |
|---|---|---|
| CN | 103219582 | 7/2013 |
| TW | M426892 | 4/2012 |
| TW | 201246685 | 11/2012 |

OTHER PUBLICATIONS

Chinese language office action dated Aug. 13, 2015, issued in application No. TW 102127223.

*Primary Examiner* — Dameon E Levi
*Assistant Examiner* — Hasan Islam
(74) *Attorney, Agent, or Firm* — McClure, Qualey & Rodack, LLP

(57) ABSTRACT

A communication device includes a ground element and an antenna element. The antenna element includes a loop metal element and a branch metal element. The loop metal element is adjacent to an edge of the ground element. The loop metal element has a feeding end and a grounding end. The grounding end is coupled to the ground element. The feeding end is coupled through a capacitive element and a first inductive element to a signal source. A closed region is enclosed by the loop metal element and the edge of the ground element. The branch metal element is coupled through a second inductive element to a connection point on the loop metal element. The connection point is at the front-half portion of the loop metal element. The front-half portion includes the feeding end. The branch metal element substantially extends along an outer periphery of the loop metal element.

8 Claims, 5 Drawing Sheets

(56) References Cited

U.S. PATENT DOCUMENTS

| | | | | |
|---|---|---|---|---|
| 8,780,007 | B2 | 7/2014 | Tseng et al. | |
| 2010/0013716 | A1* | 1/2010 | Yen | H01Q 1/243 343/700 MS |
| 2011/0102283 | A1* | 5/2011 | Chang | H01Q 7/00 343/749 |
| 2013/0050036 | A1* | 2/2013 | Kashiwagi | H01Q 1/243 343/749 |
| 2013/0057443 | A1* | 3/2013 | Asanuma | H01Q 7/00 343/751 |
| 2013/0241784 | A1* | 9/2013 | Wong | H01Q 9/14 343/749 |

* cited by examiner

COMMUNICATION DEVICE AND ANTENNA ELEMENT THEREIN

CROSS REFERENCE TO RELATED APPLICATIONS

This application claims priority of Taiwan Patent Application No. 102127223 filed on Jul. 30, 2013, the entirety of which is incorporated by reference herein.

BACKGROUND OF THE INVENTION

1. Field of the Invention

The disclosure generally relates to a communication device, and more particularly, to a tablet communication device and a small-size, wide-band/multi-band loop antenna element therein.

2. Description of the Related Art

With rapid development in the wireless communication industry, people are becoming more familiar with wireless communication products. To satisfy consumer demands, mobile communication devices should provide a variety of functions, and their appearance should be thinner and consistent with current design trends. It hence becomes a great challenge for antenna engineers to design antennas that will fit in the limited space of today's mobile communication devices to support all kinds of wireless communication applications.

BRIEF SUMMARY OF THE INVENTION

To solve the problems in the prior art, the invention provides a communication device, which comprises a small-size, wide-band/multi-band loop antenna element. The antenna element has the advantageous characteristics of having a low-profile and a small-size, and is configured to cover LTE/WWAN (Long Term Evolution/Wireless Wide Area Network) multiple bands.

In a preferred embodiment, the invention provides a communication device comprising a ground element and an antenna element. The antenna element comprises a loop metal element, and a branch metal element. The loop metal element is disposed adjacent to an edge of the ground element, wherein the loop metal element has a feeding end and a grounding end. The grounding end is coupled to the ground element, and the feeding end is coupled through a capacitive element and a first inductive element to a signal source. A closed region is enclosed by the loop metal element and the edge of the ground element. The branch metal element is coupled through a second inductive element to a connection point on the loop metal element, wherein the connection point is positioned at the front-half portion of the loop metal element. The front-half portion comprises the feeding end, and the branch metal element substantially extends along the outer periphery of the loop metal element.

In some embodiments, the closed region enclosed by the loop metal element and the edge of the ground element substantially has an inverted L-shape. In some embodiments, the loop metal element of the antenna element is configured as a loop antenna having an inverted L-shape, and the loop antenna can generate one low-frequency resonant mode and two higher-order resonant modes. In some embodiments, the low-frequency resonant mode is at about 750 MHz, and the higher-order resonant modes together form a wide band from about 1710 MHz to 2690 MHz. However, the low-frequency resonant mode often has a narrow bandwidth and generally cannot cover the desired frequency range from 704 MHz to 960 MHz, or from 824 MHz to 960 MHz.

The operating principles of the antenna element may be described as follows. The low-frequency resonant mode is excited using a capacitance provided by the capacitive element, and the capacitance causes the length of the loop metal element to be smaller than 0.2 times of the wavelength of the lowest frequency (e.g., about 704 MHz) of the first (low-frequency) band of the antenna element. In addition, at least two higher-order resonant modes of the loop metal element together form a wide band using an inductance provided by the first inductive element, and the inductance causes the bandwidth of the second (high-frequency) band of the antenna element to be increased.

The antenna element further comprises the branch metal element, which is coupled through the second inductive element to the connection point on the loop metal element. In some embodiments, the inductance of the second inductive element is greater than the inductance of the first inductive element. When the antenna element operates in the second band (high-frequency band), the second inductive element will have a high inductance and is hence nearly open-circuited. Accordingly, the branch metal element will not substantially affect the antenna element operating in the second band. In some embodiments, the width of the branch metal element is smaller than the width of the loop metal element. In some embodiments, the length of the branch metal element is 0.05 to 0.15 times of the wavelength of the lowest frequency (e.g., about 704 MHz) of the first band. The connection point of the loop metal element is positioned at the front-half portion of the loop metal element because the surface currents of the antenna's fundamental resonant mode are larger in the front-half portion and there are generally no null surface currents of the antenna's higher-order resonant modes in the front-half portion. The branch metal element substantially extends along the outer periphery of the loop metal element such that a coupling gap is formed between the branch metal element and the loop metal element. According to the above operating principles, the branch metal element can be excited to generate a parallel resonance outside the operation band (e.g., the first band) of the antenna element, and the parallel resonance can result in a resonance (zero reactance) occurred in the operation band, thereby causing a resonant mode generated to increase the operation bandwidth of the antenna element.

In some embodiments, the total size of the antenna element is just $10\times35\ mm^2$ With a low-profile and small-size structure, the antenna element is still capable of covering LTE/WWAN multiple bands.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
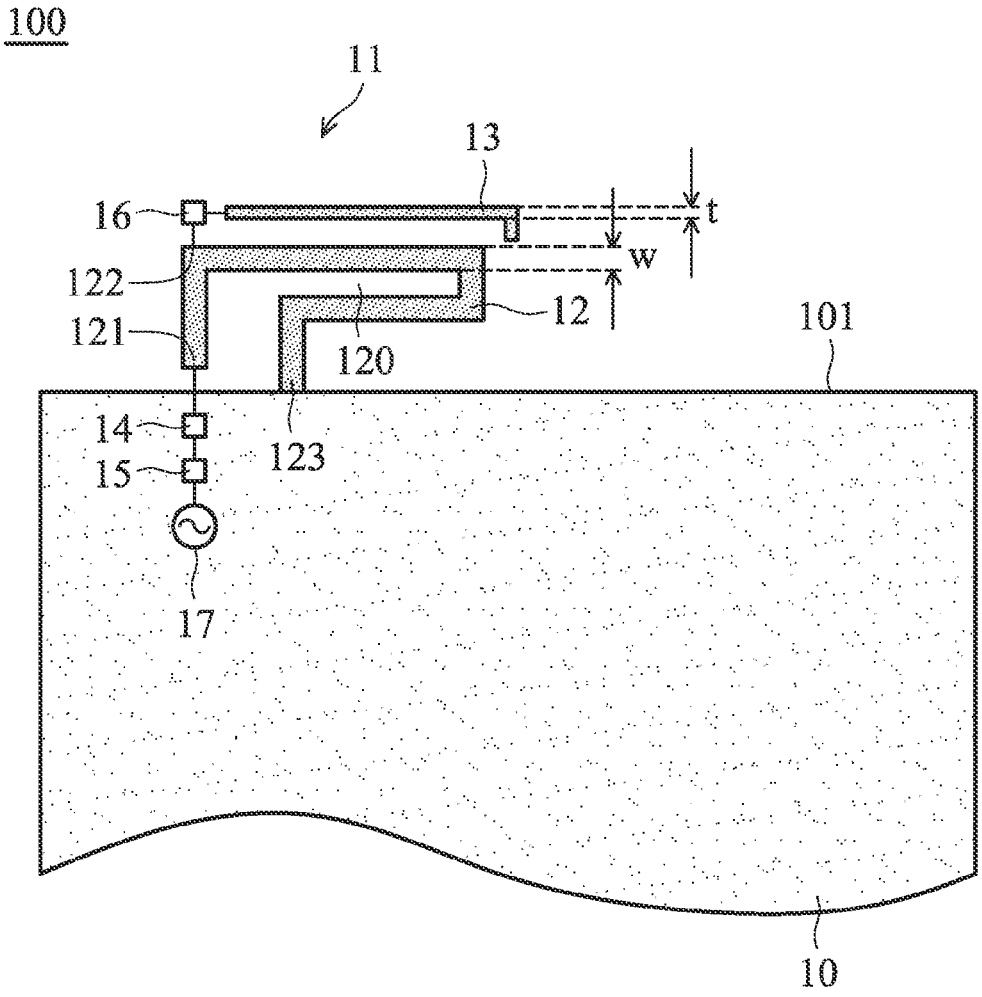
FIG. 1 is a diagram for illustrating a communication device according to a first embodiment of the invention.

FIG. 1 is a diagram for illustrating a communication device 100 according to a first embodiment of the invention. The communication device 100 may be a smartphone, a tablet computer, or a notebook computer. As shown in FIG. 1, the communication device 100 comprises a ground element 10, an antenna element 11, a capacitive element 14, a first inductive element 15, a second inductive element 16, and a signal source 17. The ground element 10 may be a metal plane disposed on a dielectric substrate (not shown), such as an FR4 (Flame Retardant 4) substrate. To save on design space, the capacitive element 14 may be a chip capacitor, and each of the first inductive element 15 and the second inductive element 16 may be a chip inductor. The antenna element 11 comprises a loop metal element 12 and a branch metal element 13. The loop metal element 12 is disposed adjacent to the edge 101 of the ground element 10. The loop metal element 12 has a feeding end 121 and a grounding end 123. The grounding end 123 is coupled to the ground element 10, and the feeding end 121 is coupled through the capacitive element 14 and the first inductive element 15 to the signal source 17. The signal source 17 may be an RF (Radio Frequency) module configured to excite the antenna element 11 to generate an operation band. A closed region 120 is enclosed by the loop metal element 12 and the edge 101 of the ground element 10. In some embodiments, the closed region 120 substantially has an inverted L-shape. In other embodiments, the closed region 120 may have other shapes, such as a straight-line shape, an inverted J-shape, or a C-shape. The branch metal element 13 is coupled through the second inductive element 16 to a connection point 122 on the loop metal element 12. The connection point 122 is positioned at the front-half portion of the loop metal element 12. The front-half portion of the loop metal element 12 comprises the feeding end 121. The branch metal element 13 substantially extends along an outer periphery of the loop metal element 12. In some embodiments, the branch metal element 13 substantially has a straight-line shape or an inverted L-shape. In some embodiments, the width t of the branch metal element 13 is smaller than the width w of the loop metal element 12. In some embodiments, the inductance of the second inductive element 16 is greater than the inductance of the first inductive element 15. Note that the communication device 100 may further comprise other components, such as a touch panel, a processor, a speaker, a battery, and a housing (not shown).

Figure 2:
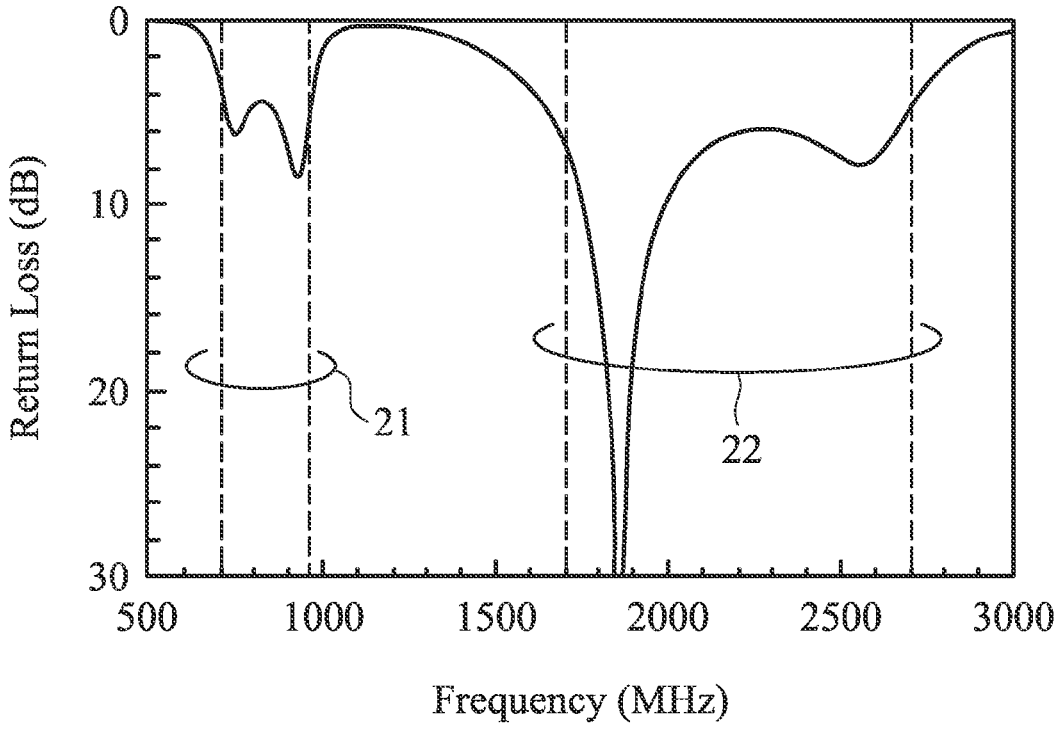
FIG. 2 is a diagram for illustrating return loss of an antenna element of a communication device according to a first embodiment of the invention.

FIG. 2 is a diagram for illustrating return loss of the antenna element 11 of the communication device 100 according to the first embodiment of the invention. As shown in FIG. 2, the antenna element 11 can operate in at least a first band 21 and a second band 22. In a preferred embodiment, the first band 21 covers the LTE700/GSM850/900 frequency range (from about 704 MHz to 960 MHz), and the second band 22 covers the GSM1800/1900/UMTS/LTE2300/2500 frequency range (from about 1710 MHz to 2690 MHz). In some embodiments, the sizes and parameters of the elements of the communication device 100 may be as follows. The ground element 10 has a length of about 200 mm and a width of about 150 mm, and this is consistent with the size of a ground element of a typical tablet communication device. The antenna element 11 has a height of about 10 mm and a length of about 35 mm. The loop metal element 12 has a length of about 65 mm. The branch metal element 13 has a length of about 38 mm. The capacitive element 14 has a capacitance of about 1.2 pF. The first inductive element 15 has an inductance of about 5.6 nH. The second inductive element 16 has an inductance of about 22 nH. The distance between the connection point 122 and the feeding end 121 of the loop metal element 12 is about 7.5 mm. The length of the loop metal element 12 is smaller than 0.2 times of the wavelength of the lowest frequency (e.g., 704 MHz) of the first band 21. The length of the branch metal element 13 is 0.05 to 0.15 times of the wavelength of the lowest frequency of the first band 21.

In some embodiments, the operating principles of the antenna element 11 may be described as follows. The branch metal element 13 is excited to generate a parallel resonance outside the operation band (e.g., the first band 21) of the antenna element 11. The parallel resonance can result in a resonance (zero reactance) occurred in the operation band, thereby causing a resonant mode generated to increase the operation bandwidth of the antenna element 11. The first inductive element 15 provides an inductance to increase the bandwidth of the second band 22. When the antenna element 11 operates in the second band 22, the second inductive element 16 is nearly open-circuited such that the branch metal element 13 does not substantially affect the antenna element 11 operating in the second band 22.

Figure 3:
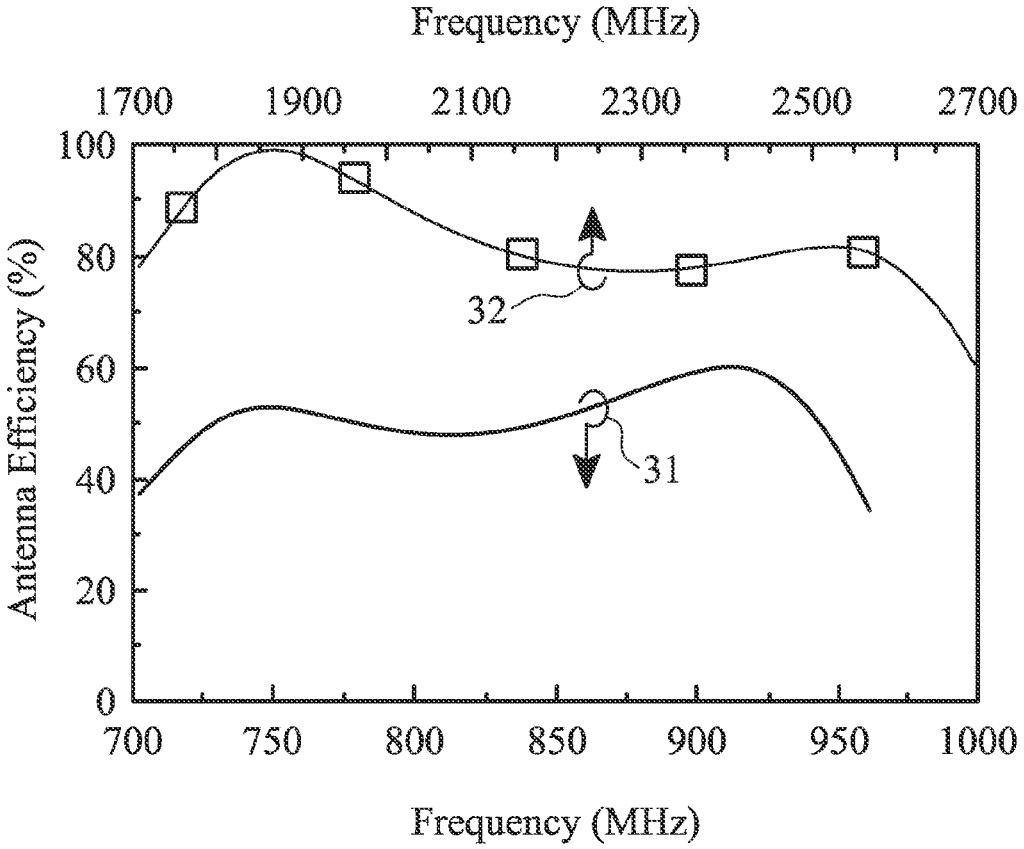
FIG. 3 is a diagram for illustrating antenna efficiency of an antenna element of a communication device according to a first embodiment of the invention.

FIG. 3 is a diagram for illustrating the antenna efficiency of the antenna element 11 of the communication device 100 according to the first embodiment of the invention. The antenna efficiency curve 31 represents the antenna efficiency (the return loss included) of the antenna element 11 operating in the first band 21 (from about 704 MHz to 960 MHz), and the antenna efficiency curve 32 represents the antenna efficiency (the return loss included) of the antenna element 11 operating in the second band 22 (from about 1710 MHz to 2690 MHz). As shown in FIG. 3, the average antenna efficiency of the antenna element 11 is approximately 50% in the first band 21 and is approximately 80% in the second band 22, thereby meeting practical application requirements.

Figure 4:
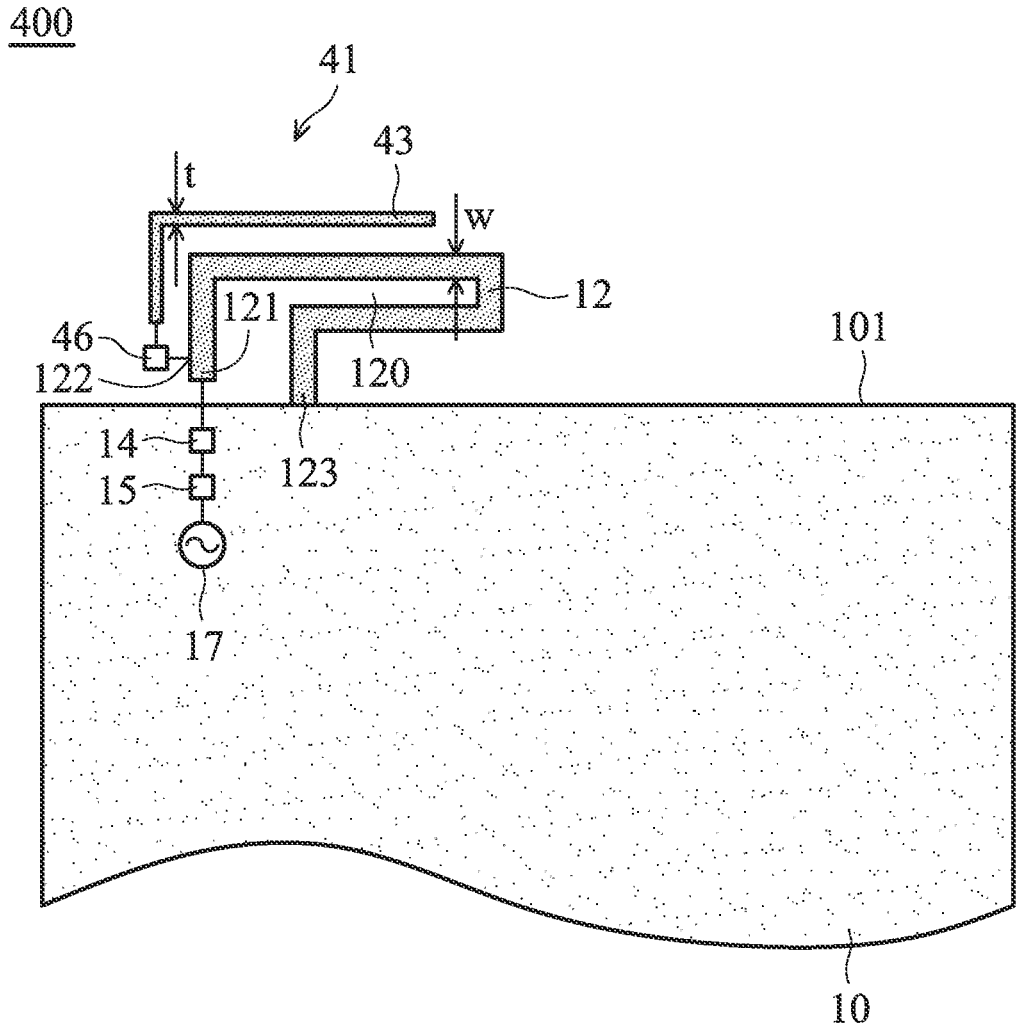
FIG. 4 is a diagram for illustrating a communication device according to a second embodiment of the invention.

FIG. 4 is a diagram for illustrating a communication device 400 according to a second embodiment of the invention. In an antenna element 41 of the second embodiment, the connection point 122 on the loop metal element 12 is adjacent to the feeding end 121 of the loop metal element 12. In addition, a branch metal element 43 is coupled through a second inductive element 46 to the connection point 122, and the branch metal element 43 substantially extends along the outer periphery of the loop metal element 12. More particularly, the branch metal element 43 partially surrounds the front-half portion of the loop metal element 12. The branch metal element 43 may substantially have an inverted L-shape. Other features of the communication device 400 of the second embodiment are similar to those of the communication device 100 of the first embodiment. Accordingly, the two embodiments can achieve similar performances.

Figure 5:
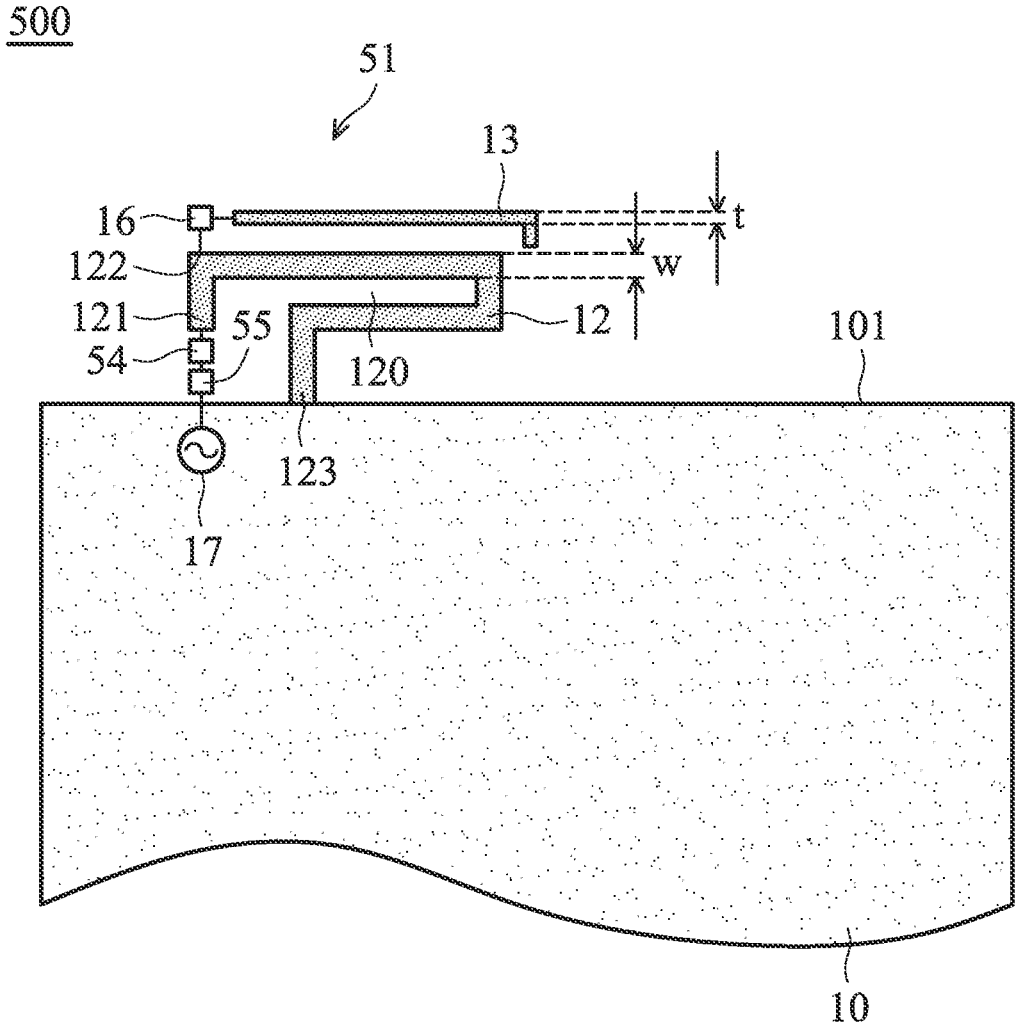
FIG. 5 is a diagram for illustrating a communication device according to a third embodiment of the invention.

FIG. 5 is a diagram for illustrating a communication device 500 according to a third embodiment of the invention. In an antenna element 51 of the third embodiment, a capacitive element 54 and a first inductive element 55 are both disposed in a clearance region above the ground element 10, wherein the capacitive element 54 and first inductive element 55 are coupled between the feeding end 121 of the loop metal element 12 and the signal source 17. That is, the capacitive element 54 and the first inductive element 55 are both disposed outside the ground element 10, and their vertical projections do not overlap with the ground element 10. Other features of the communication device 500 of the third embodiment are similar to those of the communication device 100 of the first embodiment. Accordingly, the two embodiments can achieve similar performances.

Note that the above element sizes, element shapes, and frequency ranges are not limitations of the invention. An antenna designer can adjust these values according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, comprising:

a loop metal element, disposed adjacent to an edge of the ground element, wherein the loop metal element has a feeding end and a grounding end, the grounding end is coupled to the ground element, the feeding end is coupled through a capacitive element and a first inductive element to a signal source, and a closed region is enclosed by the loop metal element and the edge of the ground element; and a branch metal element, coupled through a second inductive element to a connection point on the loop metal element, wherein the connection point is positioned at a front-half portion of the loop metal element, the front-half portion comprises the feeding end, and the branch metal element substantially extends along an outer periphery of the loop metal element;

wherein the antenna element at least operates in a first band and a second band, and frequencies of the first band are lower than frequencies of the second band;

wherein a length of the branch metal element is 0.05 to 0.15 times a length of a wavelength of the lowest frequency of the first band.

2. The communication device as claimed in claim 1, wherein a width of the branch metal element is smaller than a width of the loop metal element.

3. The communication device as claimed in claim 1, wherein the branch metal element is excited to generate a parallel resonance outside an operation band of the antenna element, and the parallel resonance can result in a resonance (zero reactance) occurred in the operation band, thereby causing a resonant mode generated to increase an operating bandwidth of the antenna element.

4. The communication device as claimed in claim 1, wherein when the antenna element operates in the second band, the second inductive element is nearly open-circuited such that the branch metal element does not substantially affect the antenna element operating in the second band.

5. The communication device as claimed in claim 1, wherein the capacitive element provides a capacitance, and the capacitance causes a length of the loop metal element to be smaller than 0.2 times of a wavelength of the lowest frequency of the first band.

6. The communication device as claimed in claim 1, wherein when the antenna element operates in the second band, the first inductive element provides an inductance, thereby increasing bandwidth of the second band.

7. The communication device as claimed in claim 1, wherein an inductance of the second inductive element is greater than an inductance of the first inductive element.

8. The communication device as claimed in claim 1, wherein the closed region enclosed by the loop metal element and the edge of the ground element substantially has an inverted L-shape.

* * * * *